US010010737B2

(12) United States Patent
Salas Peralta

(10) Patent No.: US 10,010,737 B2
(45) Date of Patent: Jul. 3, 2018

(54) MUSCULAR INTEGRAL DEVELOPMENT SYSTEM FOR RESISTANCE (MIDSYR)

(71) Applicant: Americo Salas Peralta, Cusco (PE)

(72) Inventor: Americo Salas Peralta, Cusco (PE)

( * ) Notice: Subject to any disclaimer, the term of this patent is extended or adjusted under 35 U.S.C. 154(b) by 0 days.

(21) Appl. No.: 14/867,498

(22) Filed: Sep. 28, 2015

(65) Prior Publication Data

US 2016/0016026 A1 Jan. 21, 2016

Related U.S. Application Data

(63) Continuation-in-part of application No. 13/662,856, filed on Oct. 29, 2012, now Pat. No. 9,180,330.

(51) Int. Cl.

| | |
|---|---|
| ***A63B 21/005*** | (2006.01) |
| ***A63B 24/00*** | (2006.01) |
| ***A63B 21/008*** | (2006.01) |
| ***A63B 23/035*** | (2006.01) |
| ***A63B 21/00*** | (2006.01) |
| ***A63B 23/02*** | (2006.01) |
| *A63B 71/00* | (2006.01) |
| *A63B 71/06* | (2006.01) |

(52) U.S. Cl.

CPC ..... *A63B 21/008* (2013.01); *A63B 21/005* (2013.01); *A63B 21/0058* (2013.01); *A63B 21/0083* (2013.01); *A63B 21/0087* (2013.01); *A63B 21/4043* (2015.10); *A63B 23/0205* (2013.01); *A63B 23/03533* (2013.01); *A63B 23/03575* (2013.01); *A63B 21/0059* (2015.10); *A63B 21/4007* (2015.10); *A63B 21/4011* (2015.10); *A63B 21/4015* (2015.10); *A63B 21/4021* (2015.10); *A63B 2024/0093* (2013.01); *A63B 2071/0063* (2013.01); *A63B 2071/0081* (2013.01); *A63B 2071/0625* (2013.01); *A63B 2208/0204* (2013.01); *A63B 2210/50* (2013.01)

(58) Field of Classification Search

USPC ..... 482/1, 5, 111–113, 121, 124, 78, 134, 482/142, 145, 146, 148

See application file for complete search history.

(56) References Cited

U.S. PATENT DOCUMENTS

| | | | | |
|---|---|---|---|---|
| 4,757,987 A * | 7/1988 | Allemand | A63B 22/02 | 482/54 |
| 5,391,080 A * | 2/1995 | Bernacki | A63B 69/12 | 434/254 |
| 5,449,336 A * | 9/1995 | Sabel | A61H 1/0218 | 482/130 |
| 5,941,807 A * | 8/1999 | Cassidy | A63B 22/14 | 482/130 |
| 6,123,649 A * | 9/2000 | Lee | A63B 21/153 | 482/51 |
| 6,142,914 A * | 11/2000 | Crawford | A61H 1/0214 | 280/304.1 |

(Continued)

*Primary Examiner* — Andrew S Lo
*Assistant Examiner* — Shila Jalalzadeh Abyan
(74) *Attorney, Agent, or Firm* — Defillo & Associates, Inc.; Evelyn A Defillo

(57) ABSTRACT

A muscular integral development system for resistance (MIDSYR) to develop or exercise muscles of a body of an user. The system is directed to develop an area of the body or specific muscle group, such as for example the abdominals, pectorals, biceps, buttocks or leg muscles. Furthermore, the present invention relates to an equipment to achieve weight loss, cardiovascular exercise or rehabilitation.

9 Claims, 19 Drawing Sheets

THE MUSCULAR DEVELOPMENT SYSTEM FOR RESISTANCE (MIDSYR)

(56) References Cited

U.S. PATENT DOCUMENTS

| | | | | |
|---|---|---|---|---|
| 6,508,744 | B1 * | 1/2003 | Carolus | A63B 22/00 482/148 |
| 6,558,304 | B1 * | 5/2003 | Bardon | A63B 21/00178 482/147 |
| 2004/0116253 | A1 * | 6/2004 | Radow | A63B 22/0235 482/8 |
| 2006/0229167 | A1 * | 10/2006 | Kram | A63B 21/4015 482/54 |
| 2007/0123396 | A1 * | 5/2007 | Ellis | A63B 21/0618 482/54 |
| 2011/0082013 | A1 * | 4/2011 | Bastian | A63B 22/0235 482/54 |

* cited by examiner

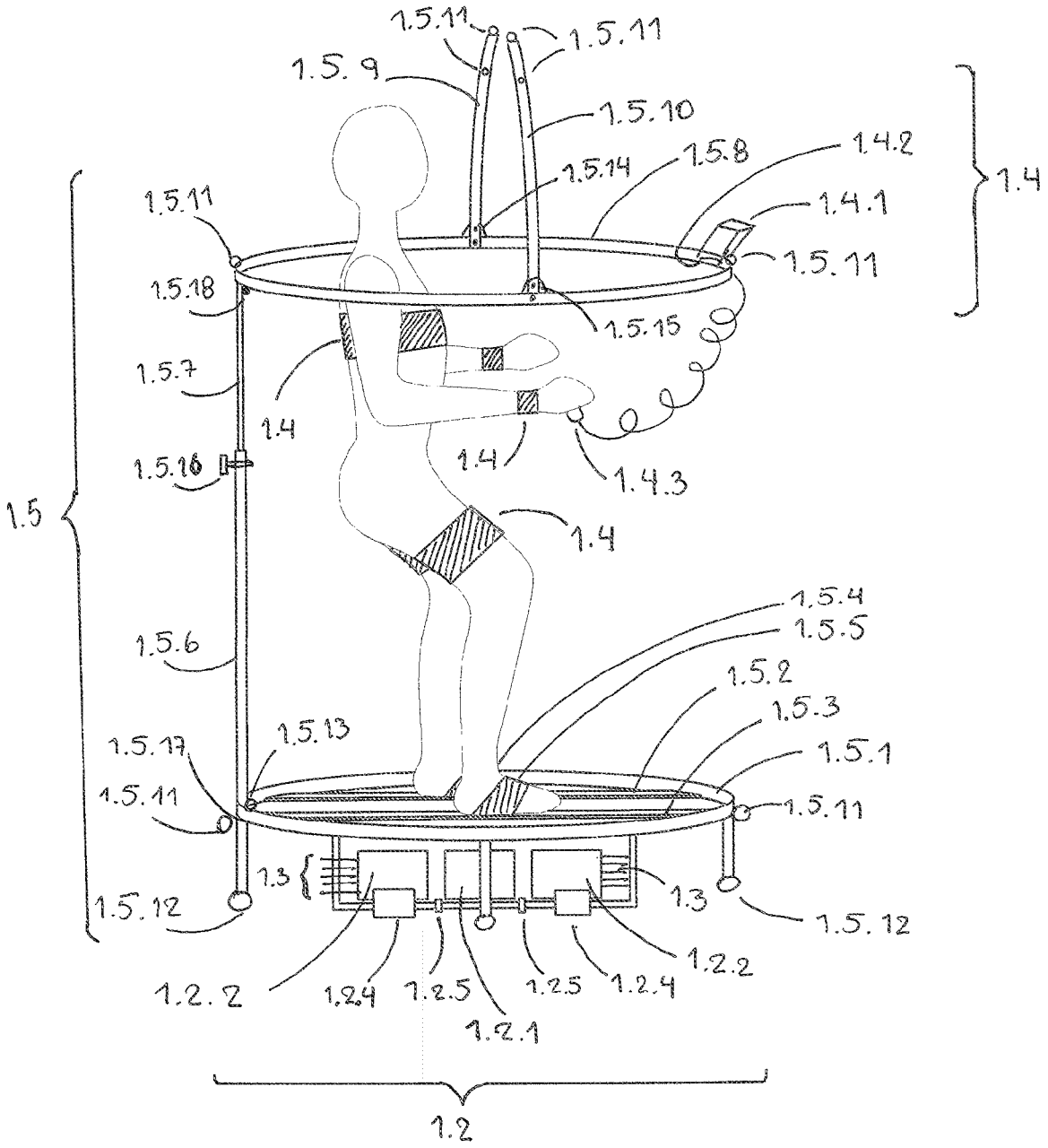
FIG. 1.– THE MUSCULAR DEVELOPMENT SYSTEM FOR RESISTANCE (MIDSYR)

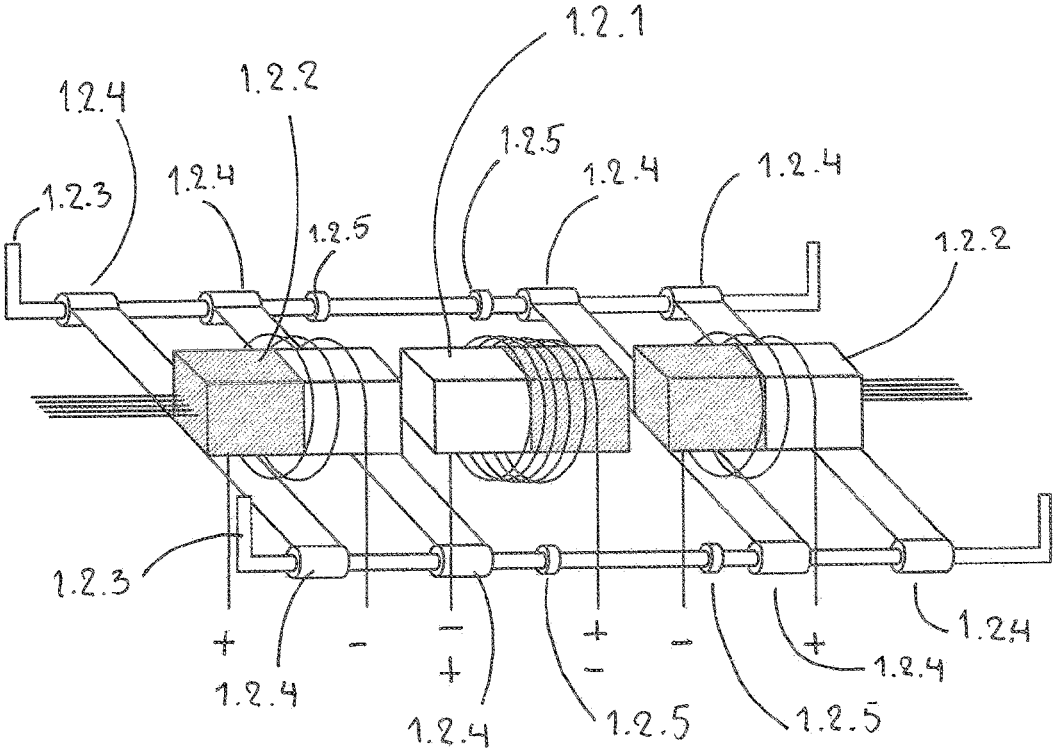
FIG. 2.– DETAILS OF THE DRIVE SYSTEM 1.2

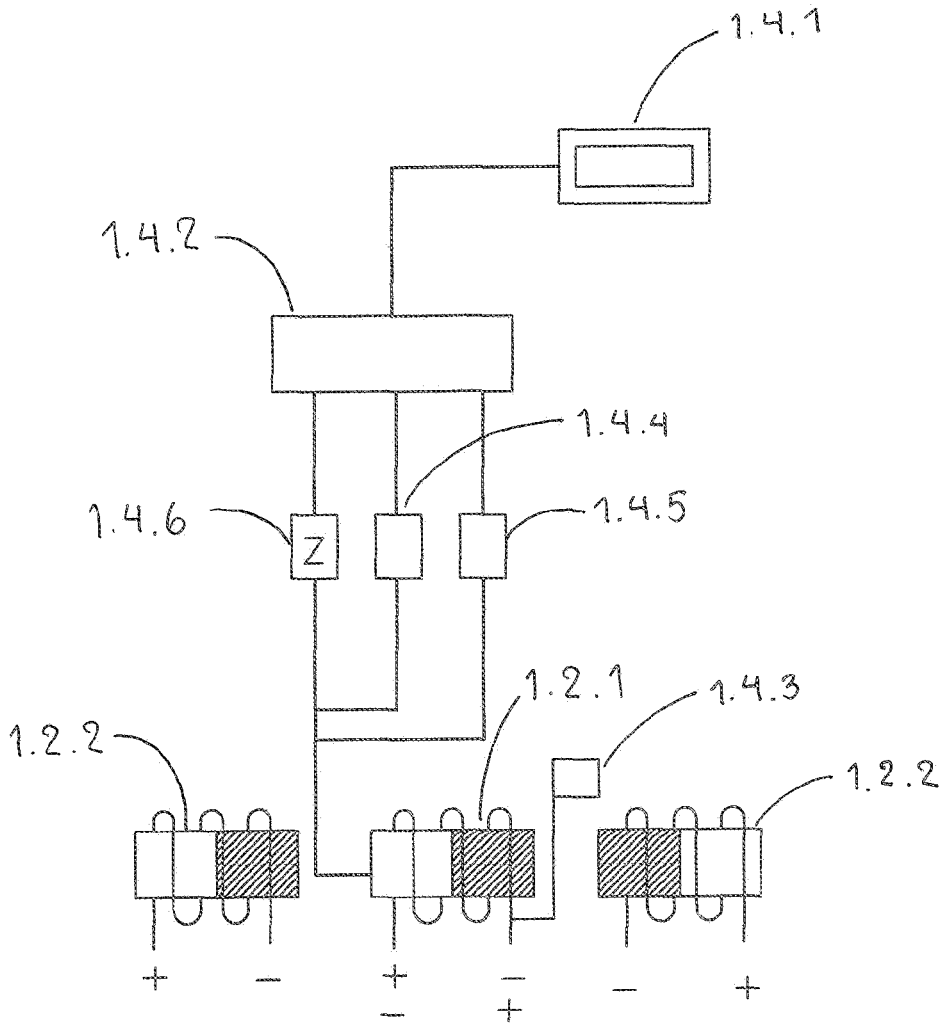
FIG. 4.– WIRING OF THE CONTROL ELEMENTS 1.6

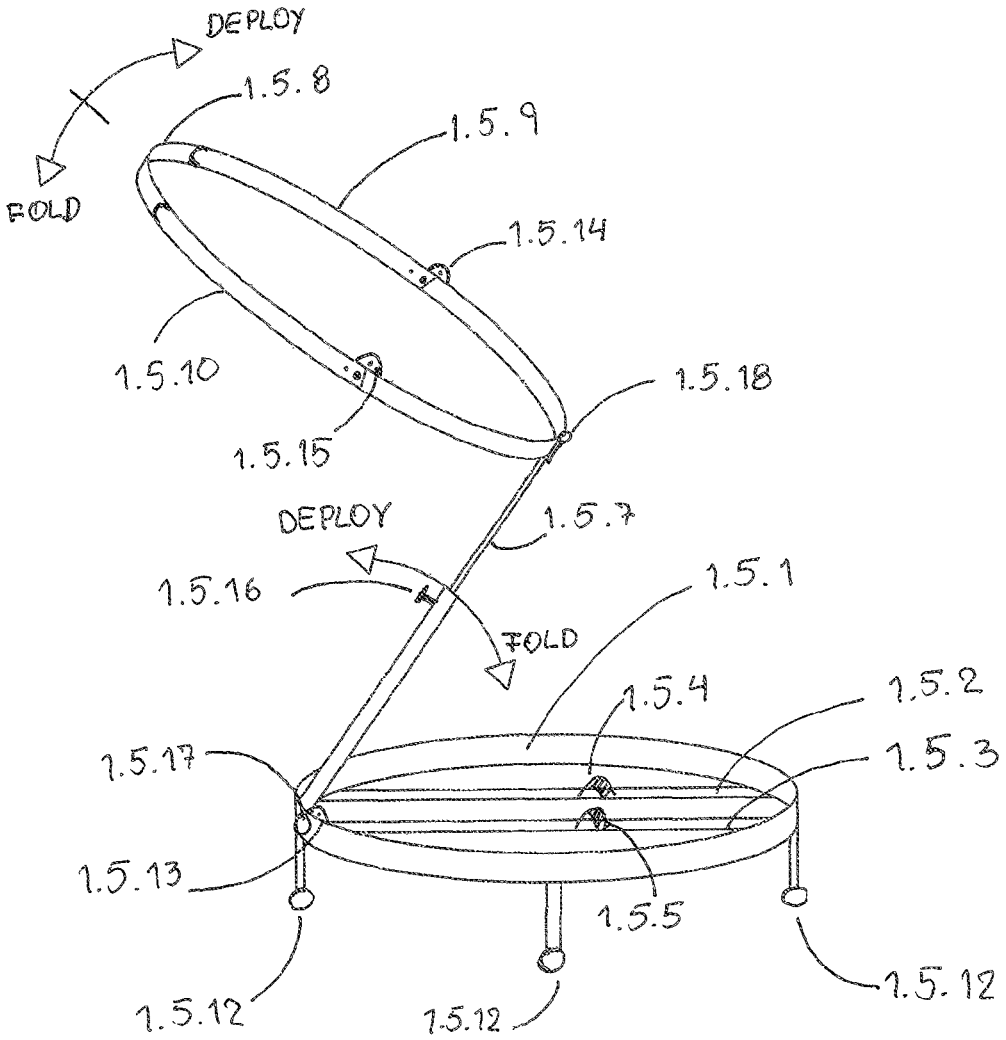
FIG 5 .– FOLDING FRAME DETAIL 1.5

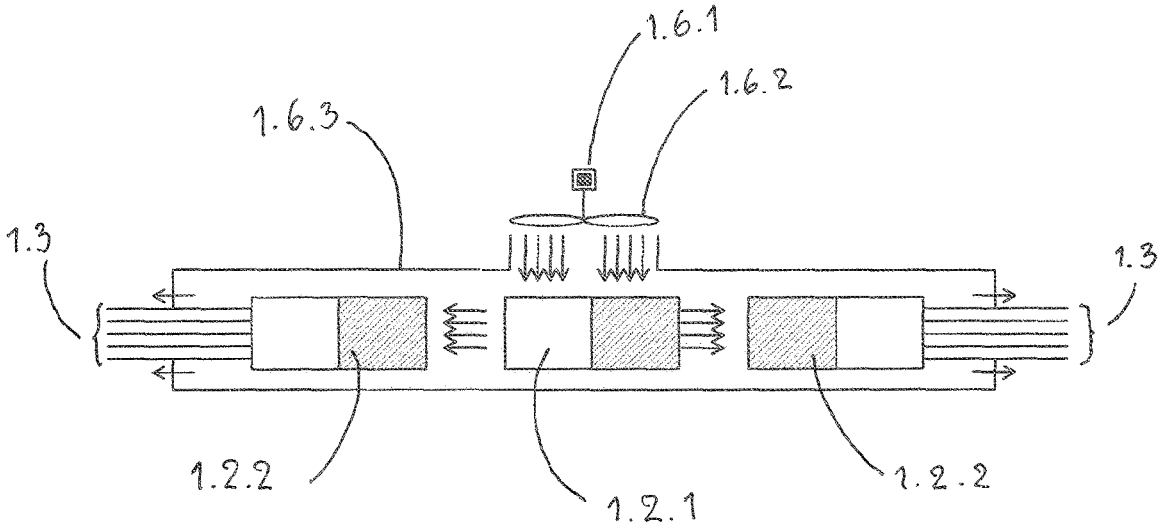
FIG. 6.– COOLING SYSTEM DIAGRAM 1.6

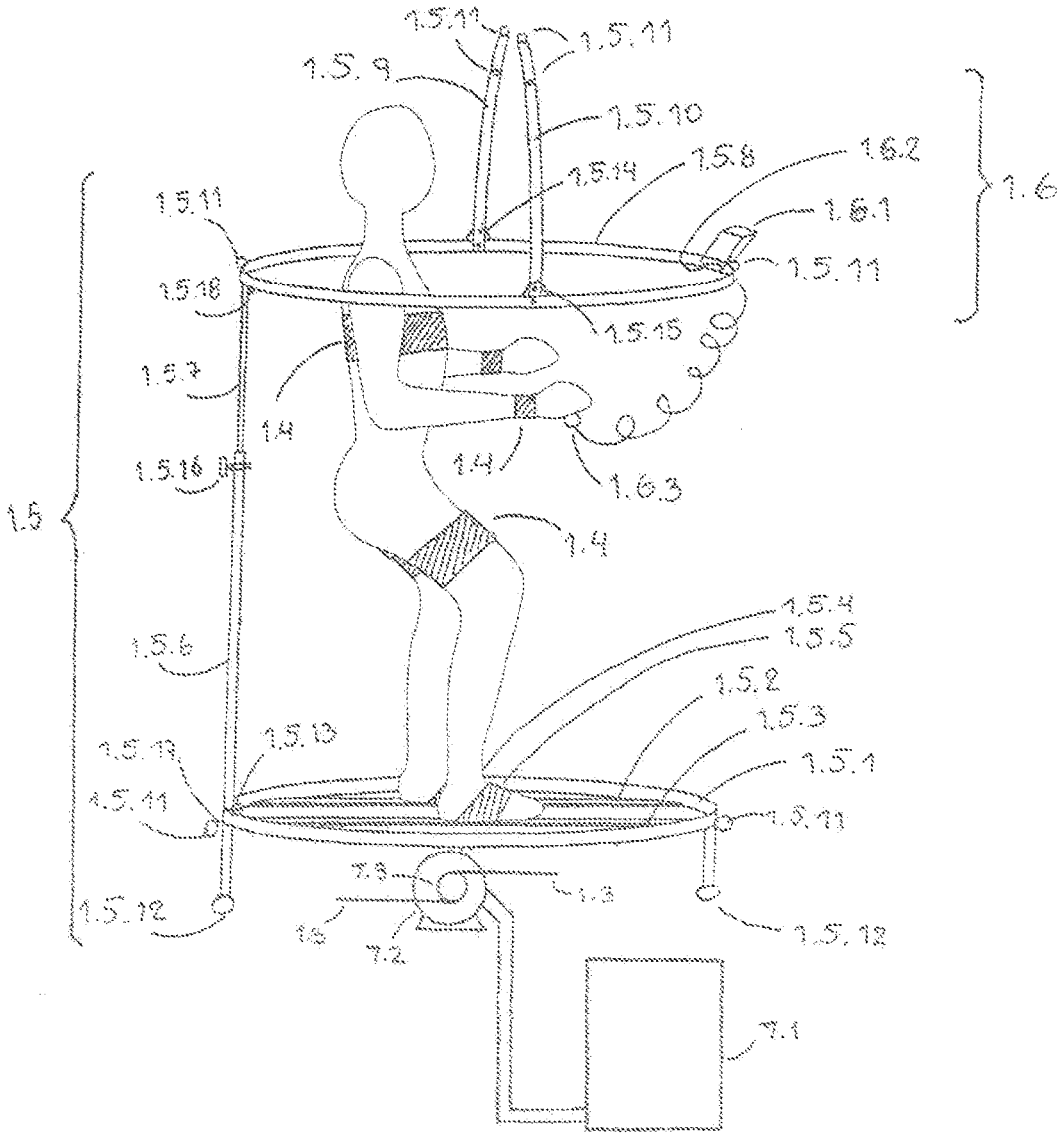
FIG 7. THE MIDSYR ACTUATED BY AN ELECTRIC ENGINE

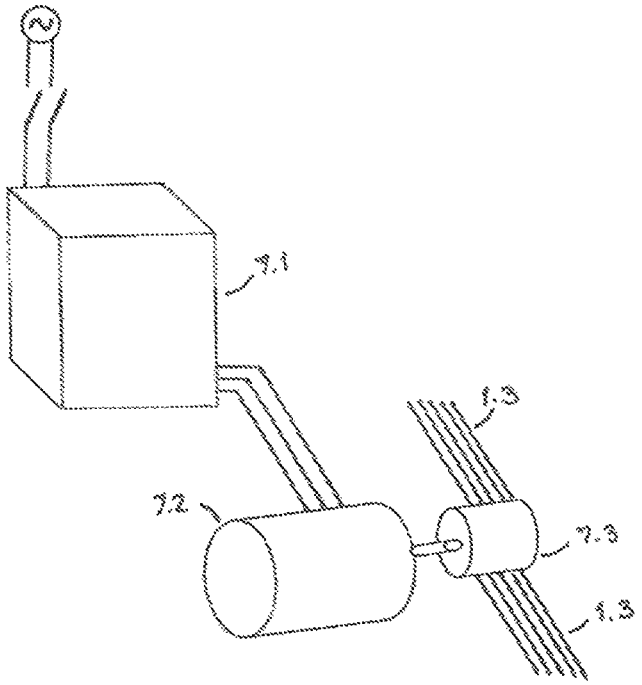
FIG 8. ARRANGEMENT OF COMPONENTS FOR THE ELECTRIC OPTION

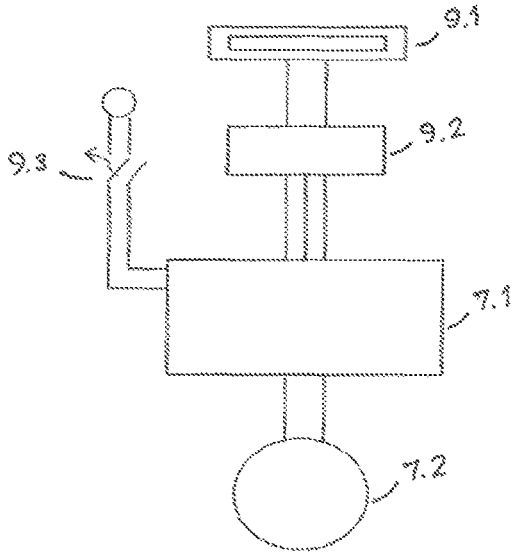
FIG 9.- DIAGRAM OF CONNECTION OF THE CONTROL ELEMENTS FOR THE ELECTRIC OPTION

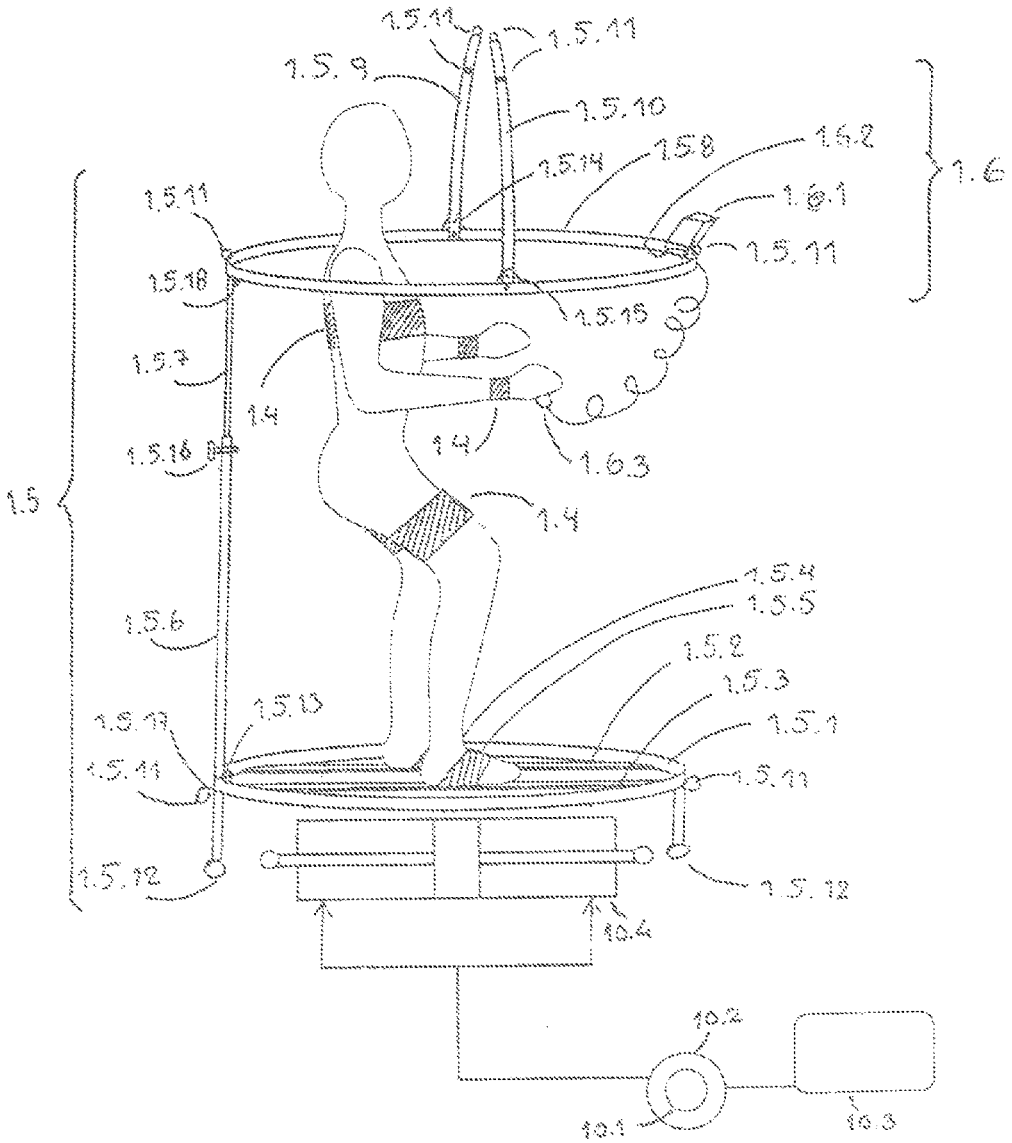
FIG 10. THE MIDSYR ACTUATED BY A HYDRAULIC PUMP

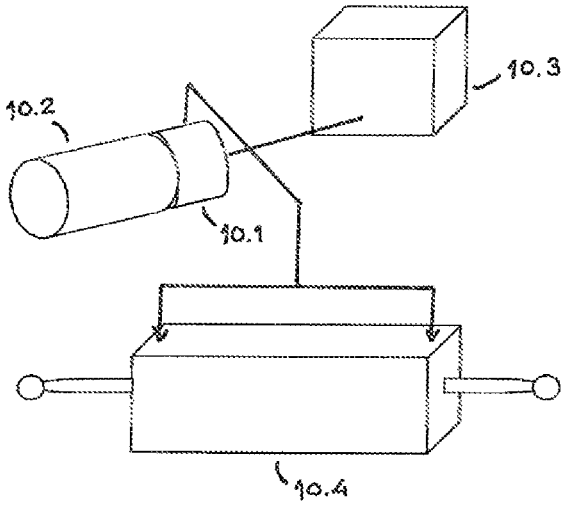
FIG 11. ARRANGEMENT OF COMPONENTS FOR THE HYDRAULIC OPTION

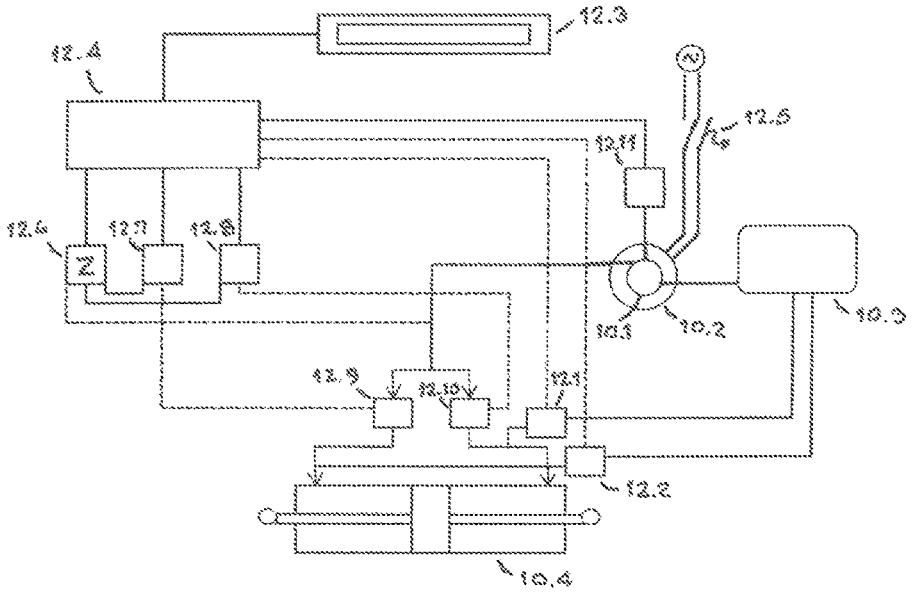
FIG 12. DIAGRAM OF CONNECTION OF THE CONTROL ELEMENTS FOR THE HYDRAULIC OPTION

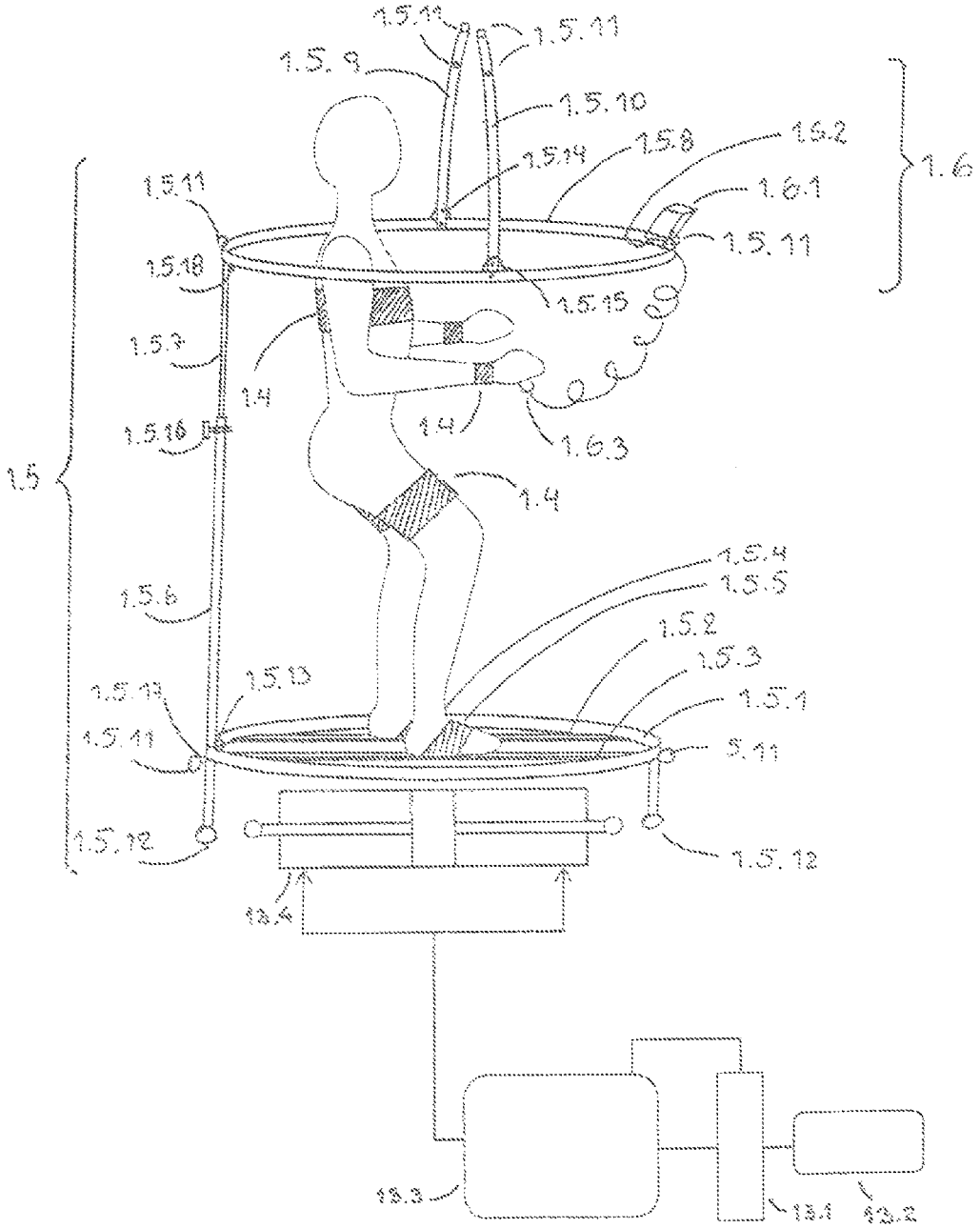
FIG 13. THE MIDSYR ACTUATED BY A PNEUMATIC COMPRESSOR

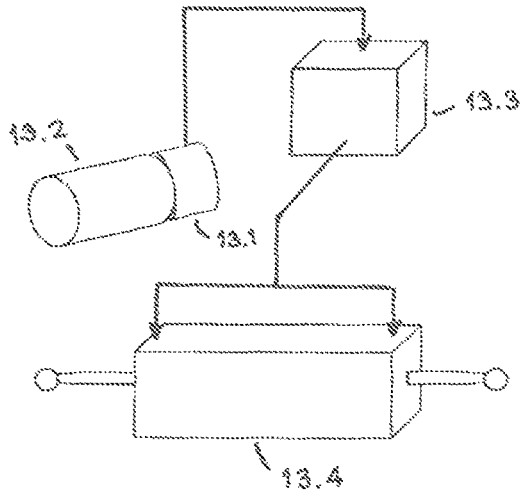
FIG 14. ARRANGEMENT OF COMPONENTS FOR THE PNEUMATIC OPTION

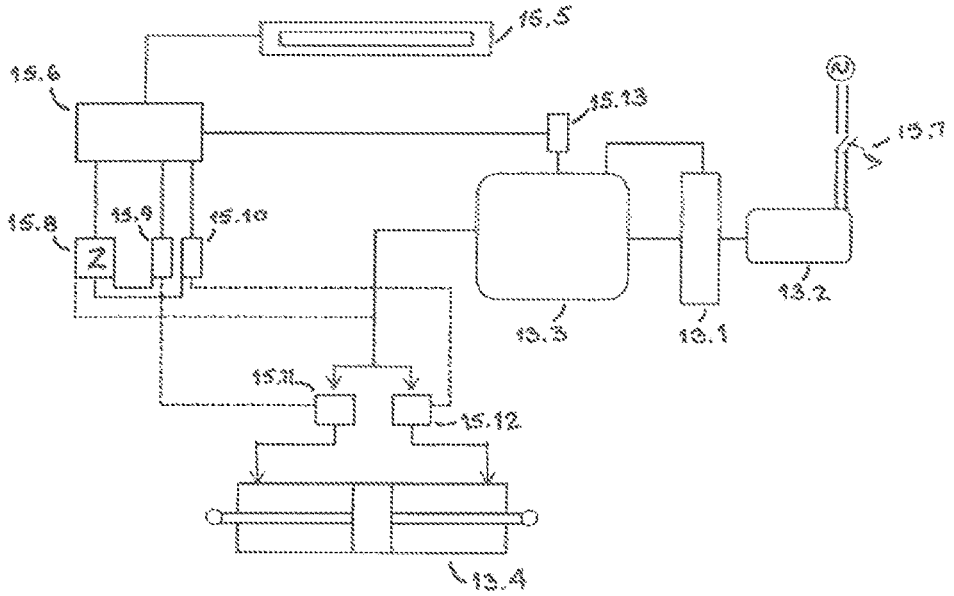
FIG 15. DIAGRAM OF CONNECTION OF THE CONTROL ELEMENTS FOR THE PNEUMATIC OPTION

MUSCULAR INTEGRAL DEVELOPMENT SYSTEM FOR RESISTANCE (MIDSYR)

CROSS REFERENCE TO RELATED U.S. APPLICATION

This application is a continuation-in-part of patent application Ser. No. 13/662,856 filed Oct. 29, 2012, entitled, MUSCULAR INTEGRAL DEVELOPMENT SYSTEM FOR RESISTANCE (MIDSYR), allowed, the disclosure of which is incorporated herein by reference.

FIELD OF INVENTION

The field of this invention corresponds to the muscle building apparatus, in which different enterprises are generally directed to develop an area of the body or specific muscle group, such as for example the abdominals, pectorals, biceps, buttocks or leg muscles. Furthermore, the field of the invention comprises equipment to achieve weight loss, cardiovascular exercise or rehabilitation.

BRIEF DESCRIPTION OF THE INVENTION

The MIDSYR is a system designed to develop or exercise the muscles of the human body as a whole, it comprises the development of the muscles of the chest, upper limbs and lower limbs by a simultaneous resistance effort. The user will be forced to develop your body muscles exert resistance against solicitation that the system will propose, this was previously programmed.

The system allows the user to select the degree or intensity of effort to unfold, alternating sequence or exercise session, the duration thereof, the pauses and the total time of the session.

MIDSYR has a power source, which in this case is a properly selected electromagnet, which transmits force to ten wires that lead to points of tension in the body of the user, conveniently located to get the desired effect. Two cables run to the torso, one in front and one in the back, four wires run to the upper extremities, two above and two in the bottom of the forearms and four wires run to the lower extremities, two of them at the top and two at the bottom of the thighs. All wires are attached to removable bands involving the body parts to exercise, that is, the torso, forearms and thighs.

When the system is activated, the user will experience a solicitation forward or backward traction in the torso and up or down in the upper and lower extremities, which must withstand the duration of the electromagnet activity according to previously selected program. MIDSYR exercises virtually every muscle a person needs to develop. Taking the advantage of meeting this objective simultaneously thus being the most effective system, and it has a lot of options to choose from in terms of intensity of the stresses, sequence, pauses or the total time of workout, being therefore very well suited for rehabilitating muscle areas or limbs of the body that require it and stimulate growth.

BRIEF DESCRIPTION OF THE DRAWINGS

FIG. 1 shows a side view of a muscular integral development system of resistance (MIDSYR) according to an exemplary embodiment of the present invention;

FIG. 2 shows a detailed view of a driving system of the muscular integral development system of resistance (MIDSYR) of FIG. 1 in which:

1.2.1—represents a main electromagnet
1.2.2—represents a field reception induced bars
1.2.3—represents a support axis
1.2.4—represents a sliding speakers
1.2.5—represents a rubber dampers FIGS. 3A-3J show a cable installation diagram 1.3 of the muscular integral development system of resistance (MIDSYR) of FIG. 1 in which:

1.3.1—represents a cable to the torso from the front (Red)
1.3.2—represents a cable to the torso from the back (Blue)
1.3.3—represents a cable to the left forearm above (Green)
1.3.4—represents a cable to the right forearm above (Yellow)
1.3.5—represents a cable to the left forearm below (Orange)
1.3.6—represents a cable to the right forearm below (Brown)
1.3.7—represents a cable to the left thigh above (Black)
1.3.8—represents a cable to the right thigh above (Pink)
1.3.9—represents a cable to the left thigh below (Grey)
1.3.10—represents a cable to the right thigh below (light blue)
1.3.11—represents removable bands FIG. 4 shows a control system diagram 1.4 of the muscular integral development system of resistance (MIDSYR) of FIG. 1 in which:

1.4.1—represents a control panel or keypad touch sensitive
1.4.2—represents a PLC Logo Unit
1.4.3—represents a safety switch
1.4.4—represents a relay 1
1.4.5—represents a relay 2
1.4.6—represents a transducer FIG. 5 shows a folding frame diagram 1.5 of the muscular integral development system of resistance (MIDSYR) of FIG. 1 in which:

1.5.1—represents a bottom circular support
1.5.2—represents a left support base
1.5.3—represents a right support base
1.5.4—represents a left fixed band
1.5.5—represents a right fixed band
1.5.6—represents a female part of telescopic column
1.5.7—represents a male part of telescopic column
1.5.8—represents an upper circular support
1.5.9—represents a left hinged arm
1.5.10—represents a right hinged arm
1.5.11—represents guideline pulleys
1.5.12—represents transport wheels
1.5.13—represents a lower end lock of column
1.5.14—represents a left hinged arm lock
1.5.15—represents a right hinged arm lock
1.5.16—represents a column height lock
1.5.17—represents a bottom Hinge
1.5.18—represents a top Hinge FIG. 6 shows a ventilation system diagram 1.6 of the muscular integral development system of resistance (MIDSYR) of FIG. 1 in which:

1.6.1—represents a motor
1.6.2—represents a fan
1.6.3—represents a ventilation duct FIG. 7 shows the muscular integral development system of resistance (MIDSYR) according to an exemplary embodiment using an electrical motor;

FIG. 8 shows the arrangement of the components of the electrical motor of FIG. 7;

FIG. 9 shows a diagram showing the connection between the components of the electrical motor of FIG. 7;

FIG. 10 shows the muscular integral development system of resistance (MIDSYR) according to an exemplary embodiment using a hydraulic pump;

FIG. 11 shows the arrangement of the components of the hydraulic pump of FIG. 10;

FIG. 12 shows a diagram showing the connection between the components of the hydraulic pump of FIG. 10;

FIG. 13 shows the muscular integral development system of resistance (MIDSYR) according to an exemplary embodiment using a pneumatic compressor;

FIG. 14 shows the arrangement of the components of the pneumatic compressor of FIG. 13; and FIG. 15 shows a diagram showing the connection between the components of the pneumatic compressor of FIG. 13.

DETAILED DESCRIPTION OF THE INVENTION

Figure 3A:
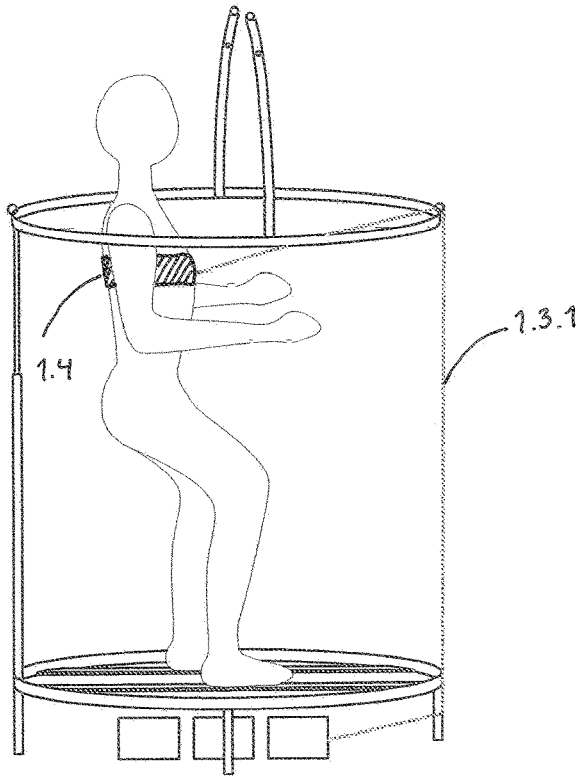
Figure 3B:
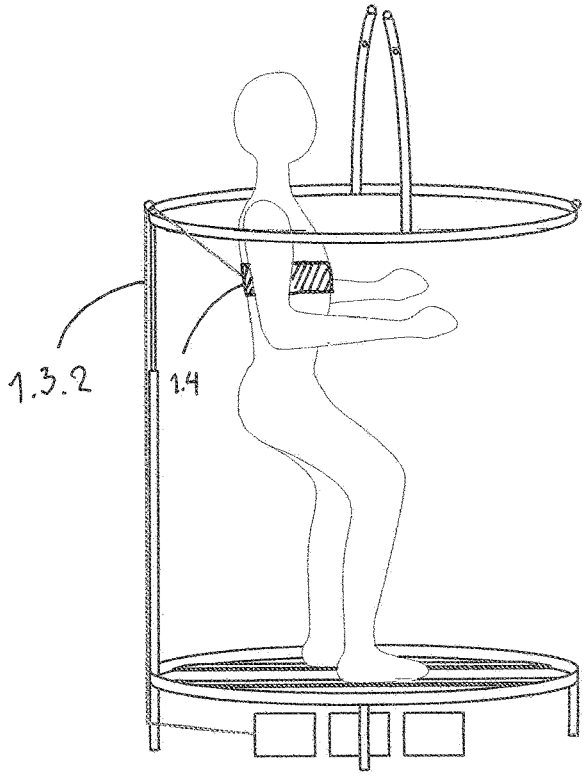
Figure 3C:
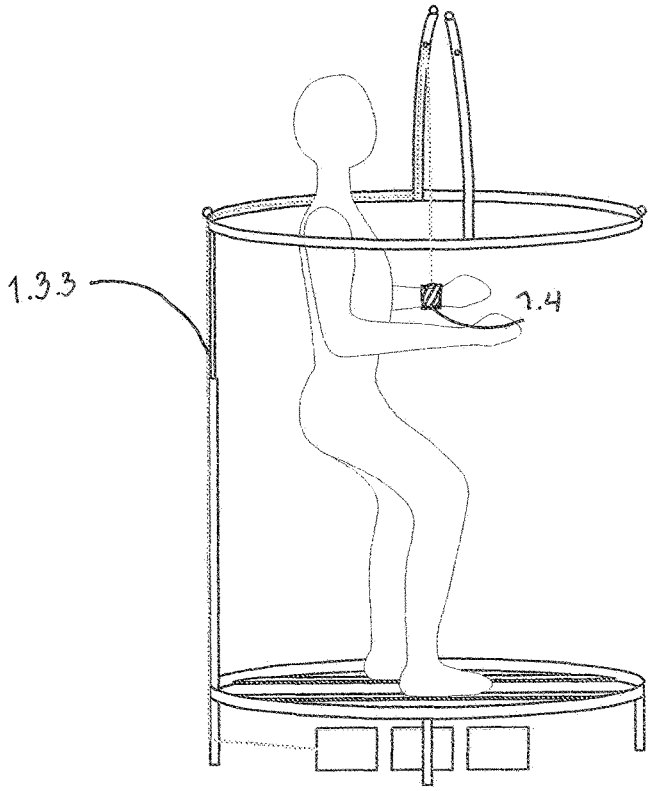
Figure 3D:
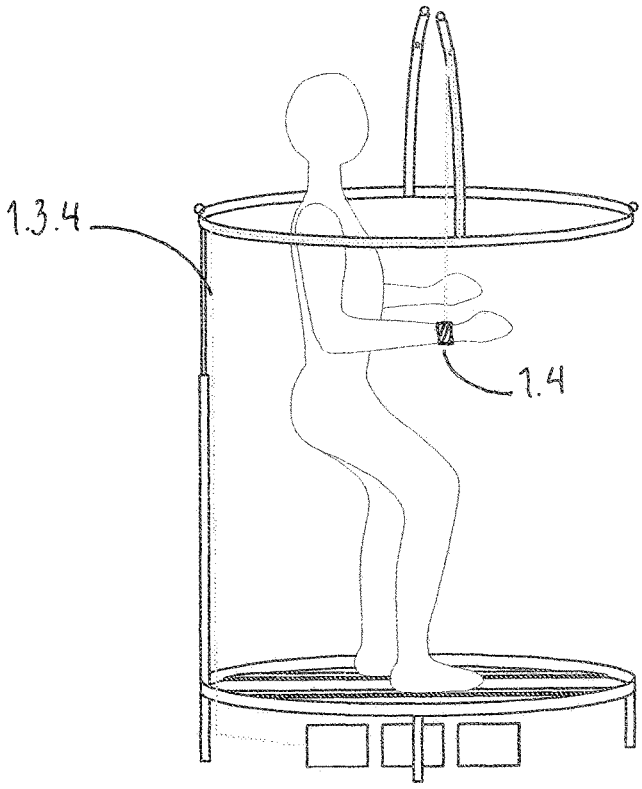
Figure 3E:
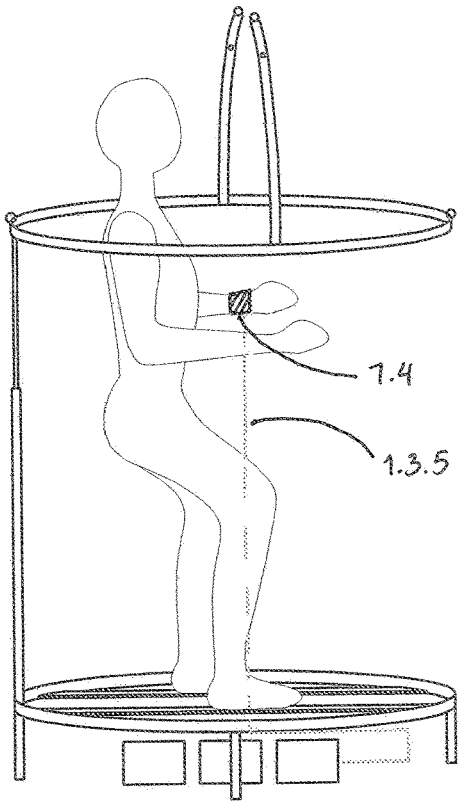
Figure 3F:
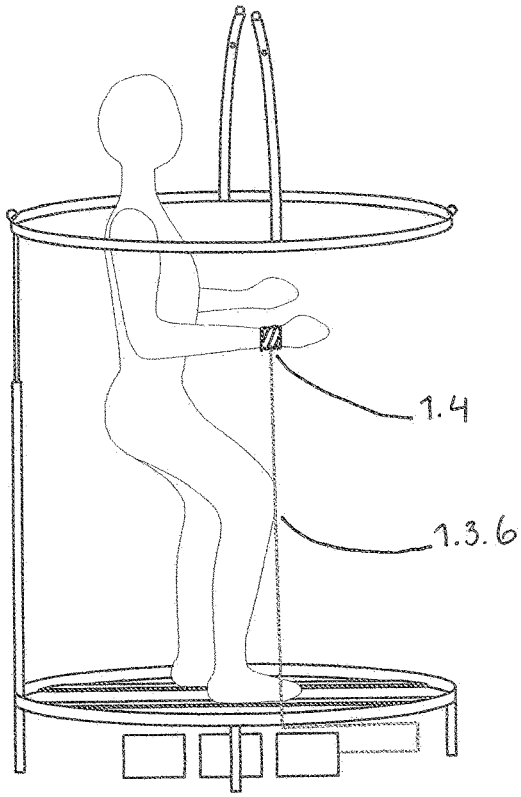
Figure 3G:
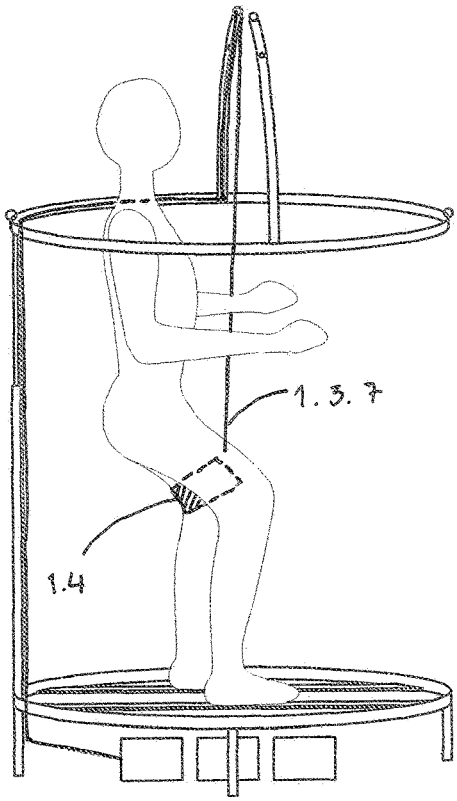
Figure 3H:
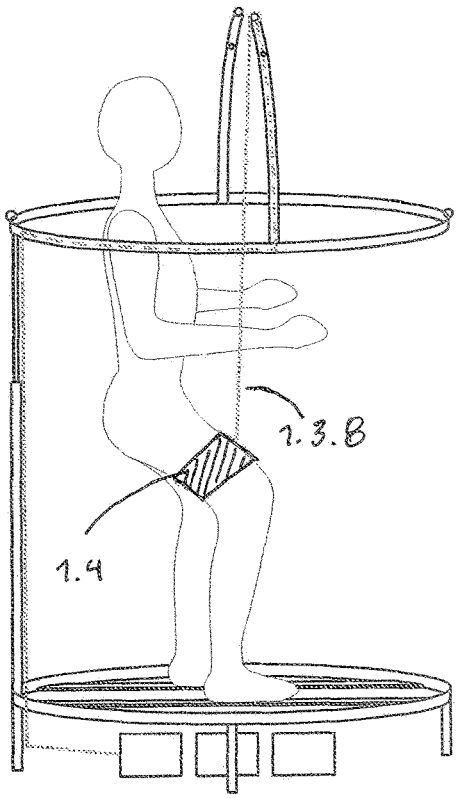
Figure 3I:
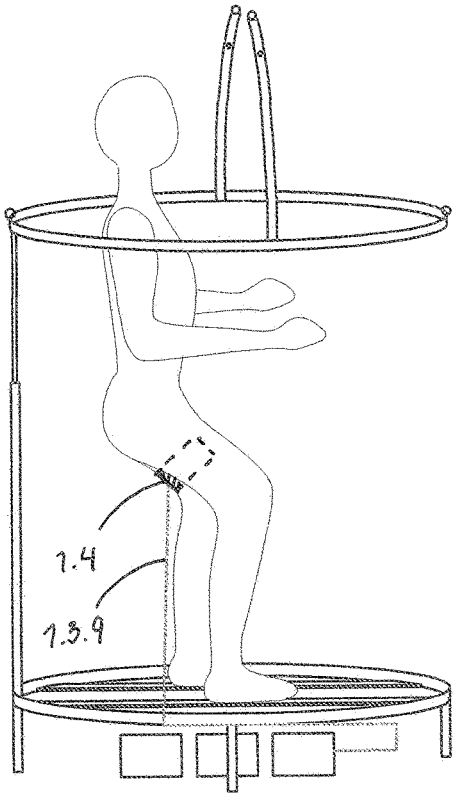
Figure 3J:
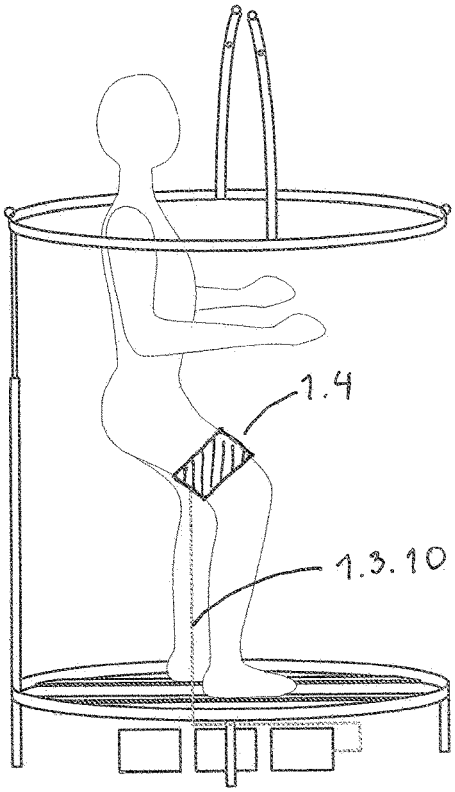

The MIDSYR is a system designed to develop or exercise the muscles of the human body as a whole, it comprises the development of the muscles of the chest, upper limbs and lower limbs by a simultaneous resistance effort. The user will be forced to develop the body muscles exerting resistance against the urging force the system will propose, and this having been previously programmed.

The system allows the user to choose the degree or intensity of effort to unfold, sequence or alternation of the exercise of the session, the duration thereof, the pauses and the total time of the session.

The MIDSYR has a power source, which in this case is a linear electromagnet appropriately selected, which being fixed transmits force towards to two, front and rear sliding magnetic metal bars of magnetic field reception and at the same time, ten wires running to the Traction points on the user's body, suitably located to obtain the desired effect. Two cables run to the torso, one in front and one in the back, four cables run to the upper extremities, two above and two in the bottom of the forearms and four wires run to the lower extremities, two of them above and two in the bottom of the thighs. The two wires for the torso are attached to a removable band placed around the user's chest, as it was said, one in front and the other in the back. The four wires to the upper extremities also are joined to removable bands placed on the user's wrist, two above (left and right forearms) and two below (left and right forearms). The four cables to the lower extremities are also joined to removable bands placed in the user's thighs, two above (left and right thighs) and two below (left and right thighs). The five wires, which run towards the body from above and back parts come out from the electromagnet towards the back area of the same and are connected to the rear sliding magnetic metal bars. While the five wires that run to the body bottom and in front, they run over the electromagnet and are linked to front sliding magnetic metal bars. On the left and right support bases, on which the user is located, in each there is fixed band to enter the feet, so that these are predicated upon them. The cables are attached to the sliding magnetic metal bars by hooks anchored in them for easy removal. The sliding magnetic metal bars move supported by two shafts, left and right, supported on the speakers with bronze core attached to the sliding magnetic metal bars and move with them sliding axially on the shafts. Both groups of wires are actuated alternately. The electromagnet is governed by controlling the intensity of the supply current, its polarity and supply times through a PLC logo (PLC acronym for Programmable Logic Controller), which is connected to a touch screen (touch panel) or keyboard, allow the user to program the required workout. The electromagnet can connect directly to the electricity supply, the voltage of 220 V, 110 V, 380 V or any other, providing the electromagnet for each case. Combinations of traction as front-back and below-above can be modified by changing the order of connection of the cables and their installation. The sliding magnet bars are electromagnets but of low intensity, polarized permanently to be attracted and repelled by the main electromagnet depending how it changes polarity. The electrical system has a cooling system that includes a motor, a fan and a compartment with openings for air input and output properly positioned (FIG. 6). Cables have a metal chain segment in the end of the connection to the slide bars, with the aim of regulating the length according to the users height and for this to deactivate the cables, disengaging them easily.

The control of the force provided by the electromagnet is performed by a current-current transducer, which regulates the intensity of the supply current to the electromagnet according to the signal sent by the PLC logo to 4-20 mA.

Controlling the polarity alternation in the main electromagnet is achieved by two relays installed in the power supply line according to FIG. 4. The alternation is controlled by the PLC logo, along the length of each feeding, pauses and total time. The alternation can be programmed or not by the user.

Finally, the PLC logo is connected to a keyboard or a visual communication screen, whereby the sequence can be programmed to the effect required. The connection diagram of the control elements is shown in FIG. 4.

To avoid impact between the sliding bars and the electromagnet, there are rubber dampers assembled around the support shaft.

When the system is activated, the user will experience a traction solicitation forward or backward in the torso and up or down in the upper and lower extremities, which must withstand during the activity of the electromagnet according to previously selected program. MIDSYR exercises virtually every muscle a person needs to develop. Taking the advantage of meeting this objective simultaneously thus becoming the most effective body-building, and have a lot of options to choose from in terms of intensity of solicitations, sequence, pauses or the total time of the workout, being therefore very well suited for rehabilitating muscle areas or limbs of the body that require it.

The system has a safety circuit to interrupt the operation of the equipment in case of need, which consists of an electric switch that the user has in hand, it is a "dead hand," that is, it is active while oppressed, if the user releases the switch, interrupts the electrical current that feeds the electromagnet, stopping MIDSYR operation.

According to what is shown in FIG. 1, the MIDSYR includes the following main parts. The main electromagnet (1.2.1) which is the source of power and attracts or repels the bars induced of field reception (1.2.2), which transmits the force of the main electromagnet to the cables (1.3), support shafts (1.2.3), which allow to the induced bars to be supported and slide on the sliding speakers (1.2.4). The rubber dampers (1.2.5) prevent impacts between adjacent components, the wires (1.3) which bear the force generated by the main electromagnet to the different body parts. The removable bands (1.3.11) used to quickly connect or disconnect the wires to the user's torso or extremities, structural folding frame (1.5), comprising by lower circular support (1.5.1), the left (1.5.2) and right support bases (1.5.3) where the user stands. The fixed bands for the left (1.5.4) and right foot (1.5.5), which hold firmly to the person when the requested force of the cables are directed upwards. The telescopic column with female (1.5.6) and male parts (1.5.7) regulate the height of the equipment, the top circular support (1.5.8) carrying two folding arms, left (1.5.9) and right (1.5.10). Guideline pulleys for cables (1.5.11) used for the direction changes of cables in their route, transport wheels (1.5.12) to facilitate the transportation of the equipment. The lower end lock of the column (1.5.13) keeps it fixed, the left hinged arm lock (1.5.14), the right hinged arm lock (1.5.15) and column height lock (1.5.16) keep each component in a fixed position. The lower hinge (1.5.17) in which the telescopic column pivots, the top hinge (1.5.18) in which the top circular support pivots. The control system (1.4), composed of the keyboard or sensitive control panel touch (1.4.1) used for programming each session, the PLC logo (1.4.2) is the brain of the equipment. The safety switch (1.4.3) that shuts down the equipment to an emergency, the relay 1 (1.4.4) and relay 2 (1.4.5) control the rotation of the main activity of the electromagnet, and the current-current transducer (1.4.6) controls the strength of the electromagnet by providing intensity toward it. Similarly, It consists of a group of ten cables (1.3), the removable bands (1.3.11), the ventilation system (1.6), consisting of the motor (1.6.1), the fan (1.6.2) and the ventilation duct (1.6.3).

The MIDSYR is folding equipment normally, favoring transport and storage. The lower circular support (1.5.1) is the equipment's base. Considering the position of the control panel (1.4.1) as the front of the machine, the lower circular support (1.5.1) has welded left (1.5.2) and right (1.5.3) support bases aligned forward and inwardly; these bases used for the user to stand on them, inserting the feet under the left (1.5.4) and right (1.5.5) fixed bands. In the back of the lower circular support, (1.5.1) there is a fixed lower hinge (1.5.17) connecting the female section to the telescopic column. Within the housing of the female section (1.5.6) of the telescopic column is placed the male section (1.5.7) of the same, which can move inside or outside of that. At the upper end of the male section of the telescopic column is fixed a second hinge (1.5.18) in which the upper circular support is attached (1.5.8). This support carries the control panel (1.4.1) that when the equipment is unfolded will be located in front thereof. In addition, this support (1.5.8) has left (1.5.9) and right (1.5.10) folding arms. These arms have a curvature radius that coincides with the inside curvature radius of the upper circular support (1.5.8), so that when folded remain close to this along the full extent. The components of the device are dimensioned such that in folded mode, that is, the shortened telescopic column and the upper circular support folded along folding arms will remain within the lower circular support, thereby achieving to occupy very little space for storage.

According to FIG. 5, the deployment of the equipment is done by following these steps:

Raise the telescopic column back (1.5.6 and 1.5.7) pivoting it within the lower hinge (1.5.17). Place the bottom end lock of the column (1.5.13).

Place the top circular support (1.5.8) in position pivoting it on the top hinge (1.5.18) of the telescopic column.

Raise the left (1.5.9) and right (1.5.10) folding arms. Place the necessary locks (1.5.14 and 1.5.15).

Place the male part (1.5.7) of the telescopic column and the upper circular support (1.5.8) to the appropriate height by removing the male section (1.5.7) up. Place the column height lock (1.5.16).

For folding the equipment, follow the steps above in reverse order.

The MIDSYR is a system that has required electronic peripheral elements to make the desired choice for any exercise session, through a keyboard or touch screen, with which you can program each of the parameters. Level or degree of force to unfold, alternation of requests (Above-below down-front), the pauses, the duration of each action and the total time of the session. Once it is programmed, the system will control the electromagnet to provide the selected force to the cables and the complete sequence of programming made for the workout. As an example, we can mention a workout that defines the following parameters:

Level: 20 Kilograms

Time duration of each solicitation: 10 seconds

Each pause time: 05 seconds

Alternation: Up-back/below-front

Total time: 20 minutes

The effect of traction in the wires of the MIDSYR can be also generated of various ways, for example using an electric motor, hydraulically or pneumatically.

To use a motor, the electromagnet may be replaced by a suitably chosen electric motor, which will transmit force through a pulley to the ten wires that carry to the traction points in the users body, as described above. The five wires leading up to the drive-behind and the five wires leading to drive down-front, they will be wrapped in the motor's pulley in opposite directions, that is, clockwise and anticlockwise respectively, depending on the motor position. In this case, there will be the necessary peripherals, such as a variable frequency drive (VFD), which serve to control the torque or force delivered by the engine. And a PLC logo unit, which the user can program the system using a keyboard or a touch screen (touch panel) choosing his/her workout also the intensity, duration of the solicitation, the pauses, the alternation and total time, similar to that previously described.

In the case of using a hydraulic system, actuated pistons may be employed by an oil or water pump driven by an electric motor, in this case providing a pressure regulator at the output of the pump, achieving to manage the force delivered to the cables by the hydraulic pistons. The sequence of steps of the program for a workout can be programmed on a PLC logo unit and a keyboard or a touch screen panel, similar to the previous case.

To use a pneumatic system, an air compressor driven by an electric motor can be used to maintain a constant predetermined pressure in a small buffer tank, which in turn will provide pressurized air to the pneumatic cylinders so that they transmit the strength to the cable assemblies. A PLC unit and a keyboard or a touch screen panel, similar to the previous cases, will program the sequence of steps of the program for a workout.

If the electrical option for actuating the invention is chosen, it is stated that in this case the power source is a suitably chosen electric motor, which shall transmit force to the cables via a pulley installed on the shaft, as shown in FIG. 7. In this case, there is a variable frequency drive (VFD stands for Variable Frequency Drive), selected to modulate the torque delivered by the motor (7.2) to the cables. The torque provided by the motor becomes force in the pulley (7.3), which is delivered to the wires (1.3), and these in turn lead to different body parts to be connected to removable strips (1.4) used to attach or quickly disengage the cables to the user's torso or limbs. The wires are attached to the pulley in ten grooves or channels in it, five clockwise and five counterclockwise (FIG. 8).

The power delivered to the cables, and the alternation, delivery times, pauses and total time of the session, are governed by a PLC logo (Abbreviation for Programmable Logic Controller) that connected to the Touch Screen (touch panel) or keyboard (9.1), shall allow the user to program his/her workout. It should be clarified here that the PLC logo can be replaced by an electronic card, for example an Arduino 2.0, which can perform the same function at a lower cost (9.2). The engine is connected to the VFD and this directly to the electricity supply, 220 V, 110 V, 380 V or other, having provided equipment for each case. As in all electrical power connection, the installation of a protection thermo magnetic switch (9.3) is being considered.

The PLC logo or electronic board controls the engine starter, polarity or reversing direction of rotation and the torque delivered by the engine. The component arrangement can be seen in FIG. 8.

The connection diagram of the control elements is shown in FIG. 9.

If the hydraulic version for actuating the invention is chosen, it is stated that in this case the power source is a hydraulic pump (10.1) driven by a motor (10.2) suitably selected, as shown in FIG. 10. To ease the description, a reciprocating hydraulic cylinder rod, which comes under pressure from the oil pump, is selected. In the piston, the pressure becomes force, which is transmitted to the wires (1.3) and lead to different body parts connected to the removable belts (1.4) which are used to attach or disengage quickly cables from torso or limbs of the user.

The hydraulic pump draws oil from a reservoir tank (10.3) and propels it towards the piston (10.4). The reservoir tank has return paths connected to the high pressure oil pipelines, each with its own electromagnetic valve (12.1, 12.2). When alternating pressure occurs between the piston chambers, the oil in the unpressurized chamber shall return to the tank through the return path when the corresponding return electromagnetic valve opens, while the other electromagnetic valve of the other return path is closed, allowing the pressurized oil flood the active chamber of the piston. The alternation in the operation of these return electromagnetic valves is controlled by the PLC logo or electronic card.

The pressure supplied to the piston and the alternance, delivery times, pauses and total time of the session are governed by the PLC logo (Abbreviation for Programmable Logic Controller) that connected to the touch screen (Touch panel) or keyboard (12.3), will allow the user to program his/her workout. It should be clarified that the PLC logo can be replaced by an electronic card, such as an Arduino 2.0, which can perform the same function at a lower cost (12.4). The pump engine can be connected directly to the electricity supply, 220 V, 110 V, 380 V or other, the pump motor in each case having provided. As in all electrical equipment, the connection has a security thermo magnetic switch (12.5).

The pressure control provided by the pump is performed by a pressure-current transducer (12.7) of 0-7 bar, which regulates the magnitude of the supply pressure to the piston according to the signal sent by the PLC logo or the electronic card (12.4) to 4-20 mA.

The alternance control of the pressure supply to the piston is achieved by two relays (12.7, 12.8) installed in the power supply line to the solenoid valves that control the passage of fluid into the piston (10.4) and receiving transducer signal Pressure-current (12.6). There is also a third relay (12.11) for communication between the pump outlet and PLC logo or electronic card for permanent information of available pressure.

The component arrangement can be seen in FIG. 11.

The connection diagram of the control elements is shown in FIG. 12.

If the pneumatic option for actuating the invention is chosen, it is stated that in this case the power source is an air compressor (13.1) actuated by a suitably chosen electric engine (13.2), as shown in FIG. 13. To ease the description, a double rod pneumatic piston, to which pressurized air arrives from the buffer tank (13.3) of the compressor (13.1), is chosen. In the piston (13.4) pressure becomes force, which is transmitted to the wires (1.3) and lead to different body parts connected to the removable belts (1.4) which are used to quickly attach or disengage cables from the torso or limbs of the user.

The pressure supplied to the piston and the alternance, delivery times, pauses and total time of the session are governed by the PLC logo (Abbreviation for Programmable Logic Controller) that connected to the touch screen (Touch panel) or keyboard (15.5), will allow the user to program his/her workout. It should be clarified that the PLC logo can be replaced by an electronic card, such as an Arduino 2.0, which can perform the same function at a lower cost (15.6). The compressor of the engine can be connected directly to the electricity supply, 220 V, 110 V, 380 V or other, having provided a compressor engine in each case. As in all electrical equipment, the connection has a thermomagnetic safety key (15.7).

The pressure control provided by the compressor is performed by a pressure-current transducer (15.8) of 0-7 bar, which regulates the magnitude of the supply pressure to the piston (13.4) according to the signal sent by the PLC logo or the electronic card (15.6) to 4-20 mA.

The alternance supply of the control pressure to the piston is achieved by two relays (15.9, 15.10) installed in the power supply line to the solenoid (15.11, 15.12) that control airflow to the piston (13.4) and receive pressure signal-current transducer (15.8). There is also a third relay (15.13) of communication between the compressor outlet and the PLC logo or electronic card for permanent information of the available pressure.

The component arrangement is shown in FIG. 14

The connection diagram of the control elements is shown in FIG. 15.

What is claimed is:

1. A muscular integral development system for resistance to develop or exercise muscles of the body of a user comprising:

a lower circular frame having a left support base and a right support base welded within the lower circular frame, a left fixed band located on the left support base, a right fixed band located on the right support base, each one of the support bases adapted to receive a corresponding leg of the user by inserting a foot on the corresponding fixed band, each one of the left support and right support bases are welded into the lower circular frame;

a top circular support frame having an inside curvature radius, the top circular support frame including two folding arms, the two folding arms protruding upwardly from the top circular support frame, the two folding arms having a curvature radius that coincides with the inside curvature radius of the top circular support frame, so that when folded, the two folding arms remain close to the inside curvature radius of the top circular support frame;

a telescopic column to vertically separate the lower circular frame from the top circular support frame, the telescopic column having a first end connected directly to the lower circular frame and a second end connected directly to the top circular support frame, wherein in a storage position the telescopic column retracts and the top circular support frame remains within the lower circular frame;

a plurality of cables;

a guideline pulley for the plurality of cables;

a control system located on the top circular support frame, the control system including a keyboard or a control panel, a programmable logic controller, a safety switch, a first relay, a second relay, and a current transducer; and a power source, the power source is selected from the group consisting of an electrical motor, a hydraulic system, and a pneumatic system;

wherein when the power source is the electric motor, the electric motor is connected to a pulley, the pulley transmits a force to a first set of cables of the plurality of cables and a second set of cables of the plurality of cables, the first set of cables and the second set of cables are wrapped on the pulley in opposite directions, the first and second sets of cables are configured to be attached respectively to the torso of the user, upper extremities of the user, and lower extremities of the user, the force transmitted to the first and second sets of cables is controlled by the programmable logic controller that is connected to the control panel or keyboard, wherein when the power source is the hydraulic system, the hydraulic system including a tank, a motor, a hydraulic pump driven by the motor and having a first end connected to the tank, a piston connected to a second end of the hydraulic pump, the piston transmits a force to plurality of cables configured to be attached to the torso of the user, upper extremities of the user, and lower extremities of the user, the force transmitted to the plurality of cables is controlled by the programmable logic controller that is connected to the control panel or keyboard, and wherein when the power source is the pneumatic system, the pneumatic system includes an air compressor driven by an electric motor that actuates a piston, the piston transmits a force to the plurality of cables configured to be attached to the torso of the user, upper extremities of the user, and lower extremities of the user, the force transmitted to the plurality of cables is controlled by the programmable logic controller that is connected to the control panel or keyboard; and wherein the plurality of cables are attached to removable bands configured to be placed around the chest of the user, around both wrists of the user, and around both thighs of the user.

2. The system according to claim 1, wherein the plurality of cables further comprise one or more cables for exercising the muscles of the neck of the user or muscles of the back of the user.

3. The system according to claim 1, wherein the programmable logic controller is replaced by a personal computer or laptop.

4. The system according to claim 1, wherein the system is installed in a vertical position.

5. The system according to claim 1, wherein the system is installed in a horizontal position.

6. The system according to claim 1, wherein the power source is the electric motor.

7. The system according to claim 1, wherein the power source is the hydraulic system.

8. The system according to claim 1, wherein the power source is the pneumatic system.

9. A muscular integral development system for resistance to develop or exercise muscles of the body of a user consisting of:

a lower circular frame having a left support base and a right support base welded within the lower circular frame, a left fixed band located on the left support base, a right fixed band located on the right support base, each one of the support bases adapted to receive a corresponding leg of the user by inserting a foot on the corresponding fixed band, each one of the left support and right support bases are welded into the lower circular frame;

a top circular support frame having an inside curvature radius, the top circular support frame including two folding arms, the two folding arms protruding upwardly from the top circular support frame, the two folding arms having a curvature radius that coincides with the inside curvature radius of the top circular support frame, so that when folded, the two folding arms remain close to the inside curvature radius of the top circular support frame;

a telescopic column to vertically separate the lower circular frame from the top circular support frame, the telescopic column having a first end connected directly to the lower circular frame and a second end connected directly to the top circular support frame, wherein in a storage position the telescopic column retracts and the top circular support frame remains within the lower circular frame;

a plurality of cables;

a guideline pulley for the plurality of cables;

a control system located on the top circular support frame, the control system including a keyboard or a control panel, a programmable logic controller, a safety switch, a first relay, a second relay, and a current transducer; and a power source, the power source is selected from the group consisting of an electrical motor, a hydraulic system, and a pneumatic system;

wherein when the power source is the electric motor, the electric motor is connected to a pulley, the pulley transmits a force to a first set of cables of the plurality of cables and a second set of cables of the plurality of cables, the first set of cables and the second set of cables are wrapped on the pulley in opposite directions, the first and second sets of cables are configured to be attached respectively to the torso of the user, upper extremities of the user, and lower extremities of the user, the force transmitted to the first and second sets of cables is controlled by the programmable logic controller that is connected to the control panel or keyboard, wherein when the power source is the hydraulic system, the hydraulic system including a tank, a motor, a hydraulic pump driven by the motor and having a first end connected to the tank, a piston connected to a second end of the hydraulic pump, the piston transmits a force to the plurality of cables configured to be attached to the torso of the user, upper extremities of the user, and lower extremities of the user, the force transmitted to the cables is controlled by the programmable logic controller that is connected to the control panel or keyboard, and wherein when the power source is the pneumatic system, the pneumatic system includes an air compressor driven by an electric motor that actuates a piston, the piston transmits a force to the plurality of cables configured to be attached to the torso of the user, upper extremities of the user, and lower extremities of the user, the force transmitted to the plurality of cables is controlled by the programmable logic controller that is connected to the control panel or keyboard; and wherein the plurality of cables are attached to removable bands configured to be placed around the chest of the user, around both wrists of the user, and around both thighs of the user.

* * * * *